US009708094B2

(12) United States Patent
Shaw

(10) Patent No.: US 9,708,094 B2
(45) Date of Patent: Jul. 18, 2017

(54) CORRECTIONAL FACILITY INMATE FOOT LOCKER CONSTRUCTED OF A CORRUGATED AND NON-WEAPONIZABLE MATERIAL

(71) Applicant: Raymond R. Shaw, Farmington Hills, MI (US)

(72) Inventor: Raymond R. Shaw, Farmington Hills, MI (US)

(73) Assignee: Raymond R. Shaw, Farmington Hills, MI (US)

( * ) Notice: Subject to any disclaimer, the term of this patent is extended or adjusted under 35 U.S.C. 154(b) by 0 days.

(21) Appl. No.: 15/062,976

(22) Filed: Mar. 7, 2016

(65) Prior Publication Data

US 2016/0257443 A1 Sep. 8, 2016

Related U.S. Application Data

(60) Provisional application No. 62/129,073, filed on Mar. 6, 2015.

(51) Int. Cl.

| | |
|---|---|
| ***B65D 5/22*** | (2006.01) |
| ***B65D 5/46*** | (2006.01) |
| ***B65D 5/66*** | (2006.01) |
| ***B65D 5/20*** | (2006.01) |
| ***B65D 5/42*** | (2006.01) |
| ***B65D 5/468*** | (2006.01) |

(52) U.S. Cl.

CPC ..... *B65D 5/2052* (2013.01); *B65D 5/22* (2013.01); *B65D 5/4204* (2013.01); *B65D 5/4608* (2013.01); *B65D 5/6611* (2013.01); *B65D 5/6661* (2013.01); *B65D 2313/02* (2013.01)

(58) Field of Classification Search

CPC ..... B65D 5/22; B65D 5/6626; B65D 5/4608; B65D 5/6673; B65D 5/4204

USPC .... 229/117.16, 125.37, 141, 149, 162.6, 178

See application file for complete search history.

(56) References Cited

U.S. PATENT DOCUMENTS

| | | | | |
|---|---|---|---|---|
| 2,869,770 A * | 1/1959 | Bass | B65D 5/4616 229/117.14 |
| 3,745,596 A | 7/1973 | Copeland | |
| 3,749,301 A * | 7/1973 | Peckar | B65D 5/6673 220/315 |
| 4,167,242 A * | 9/1979 | Kupersmit | B65D 5/6673 206/807 |
| 4,717,023 A * | 1/1988 | Oprean | A45C 3/02 206/459.5 |

(Continued)

*Primary Examiner* — Gary Elkins

(74) *Attorney, Agent, or Firm* — Dinsmore & Shohl LLP

(57) ABSTRACT

An inmate locker incorporating a corrugated paperboard board having a generally three dimensional rectangular body with an open interior. The body includes a lid hingedly attached along an edge thereof, the lid including one or more window apertures which are covered by a flexible mylar or other plastic material adhered to outer or underside perimeter encircling edges of the lid. The lid further includes a fold over flap exhibiting at least one inter-engaging portion configured on an inner facing surface and which, upon closing the lid over an open top of the body, interengages with an aligning inter-engaging portion configured upon an exterior facing side location of the body. Handhold apertures are configured at overlapping locations of the fold over flap and side location of the body upon closing and sealing the lid over the open top.

3 Claims, 4 Drawing Sheets

(56) References Cited

U.S. PATENT DOCUMENTS

| | | | | |
|---|---|---|---|---|
| 4,817,861 | A * | 4/1989 | Henrikson | B42F 17/02 206/425 |
| 5,018,663 | A * | 5/1991 | Corso | B65D 5/22 229/117.13 |
| 5,095,566 | A | 3/1992 | Russell | |
| 5,524,816 | A | 6/1996 | Zriny | |
| 7,673,787 | B2 * | 3/2010 | Mittelstaedt | B65D 5/22 229/117.16 |
| 2014/0175101 | A1 * | 6/2014 | Dixon | B65D 5/6661 220/529 |

* cited by examiner

CORRECTIONAL FACILITY INMATE FOOT LOCKER CONSTRUCTED OF A CORRUGATED AND NON-WEAPONIZABLE MATERIAL

CROSS REFERENCE TO RELATED APPLICATIONS

The present invention claims the priority of U.S. Ser. No. 62/129,073 filed Mar. 6, 2015, the contents of which are incorporated herein in its entirety.

FIELD OF THE INVENTION

The present invention discloses an inmate locker for use in a correctional facility. The locker exhibits a corrugated paperboard having a generally three dimensional rectangular body with an open interior. A lid includes one or more window apertures which are covered by a flexible Mylar or other plastic material, such as which can be glued or otherwise adhered to outer or underside perimeter encircling edges of the lid. A fold over flap associated with the lid includes at least one hook and loop fastener portion configured on an inner facing surface and which, upon closing the lid over the open top of the body, interengages with an aligning hook and loop fastener portion configured upon an exterior facing side location of the body. Hand hold apertures are configured in the flap and side of the body and align upon closing and sealing the lid.

DESCRIPTION OF THE BACKGROUND ART

An ongoing concern with correctional facilities is the ever present risk of impromptu weapons fashioned by inmates. Such can include not only silverware or other obvious objects, but also other unexpected materials. Another problem in managing inmate populations is the requirement of providing storage for the inmates personal possessions and the safety issues such may raise.

One known storage locker solution is disclosed in U.S. Pat. No. 5,095,566, to Russell, teaches a storage locker having a bottom and a pair of end walls secured to the bottom. A back wall is secured to the bottom and to the pair of end walls. An angle iron member is secured to the pair of end walls and a locker door is pivotally secured to the angle iron member. The storage locker may be secured to a bed in a prison cell.

Other references in the art include U.S. Pat. No. 3,745,596, to Copeland, which teaches a bed frame or combined bed frame for storage compartment having side rails with extension end bars for adapting the bed frame to different length and width beds and provided with attaching plates to secure any head and foot boards thereto, for use without end boards, legs are provided in the same end assembly with caster wheels for support of the bed frame independently of any head or foot boards. Lateral supports including projections adjustably opposing one another from the corresponding ends of the side rails and entering into the end assemblies to provide a rigid construction. Extension members adjustably interconnecting the projections forming the drawer guides for the storage drawers to provide the full lateral supports for the bed frame.

Finally U.S. Pat. No. 5,524,816, to Zriny, discloses a tri-fold lid storage box which enables the user to convert available storage space underneath a bed into usable storage. The storage box is comprised of a separate box and lid, the box having a triple reinforced front panel for pulling the box outward, the lid having a specially designed lid which can fold back either ⅓, ⅔ or be completely removed. The lid is also removably attached to the storage box and is specially designed so the user may lock the lid into the ⅔ open position so that the user can view and manipulate the contents of the box without having to hold the lid open. The boxes are specially dimensioned so that they fully utilize the storage space available underneath a standard size bed.

SUMMARY OF THE PRESENT INVENTION

The present invention discloses an inmate locker incorporating a corrugated paperboard board having a generally three dimensional rectangular body with an open interior. The body includes a lid hingedly attached along an edge thereof, the lid including one or more window apertures which are covered by a flexible mylar or other plastic material adhered to outer or underside perimeter encircling edges of the lid.

The lid further includes a fold over flap exhibiting at least one inter-engaging portion configured on an inner facing surface and which, upon closing the lid over an open top of the body, interengages with an aligning inter-engaging portion configured upon an exterior facing side location of the body. Handhold apertures are configured at overlapping locations of the fold over flap and side location of the body upon closing and sealing the lid over the open top.

Additional features include the body having a flattened blank construction including includes a rectangular shaped bottom panel about which are arranged hinged side panels. End flaps are arranged in alternating fashion with the side panels, the end flaps being arranged in pairs which are hingedly connected to opposite side edges of selected side panels and, upon upwardly folding the side panels relative the bottom into the open rectangular configuration, the ends flaps are folded over exterior surfaces of additional selected side panels.

Other features include the provision of additional fold over flaps which are hingedly supported in extending fashion from outer edges of selected side panels, the additional fold over flaps folding against inside surfaces of selected side panels, following placement of the end flaps, and in order to increase the structural integrity of the body. The inter-engaging portions may also include hook and loop fastener portions. A selected one of said hand-hold apertures further comprising fold-over creases.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

As previously described, the present invention discloses an inmate locker for use in a correctional facility, such as which can be produced of inexpensive and non-weaponizable materials. The locker is intended to provide a low cost and effective option for providing the inmate with a usable locker device having adequate holding capacity and which avoids the incorporation of any materials exhibit any type of rigid construction which can potentially be fashioned into a weapon having a sharpened edge.

Figure 1:
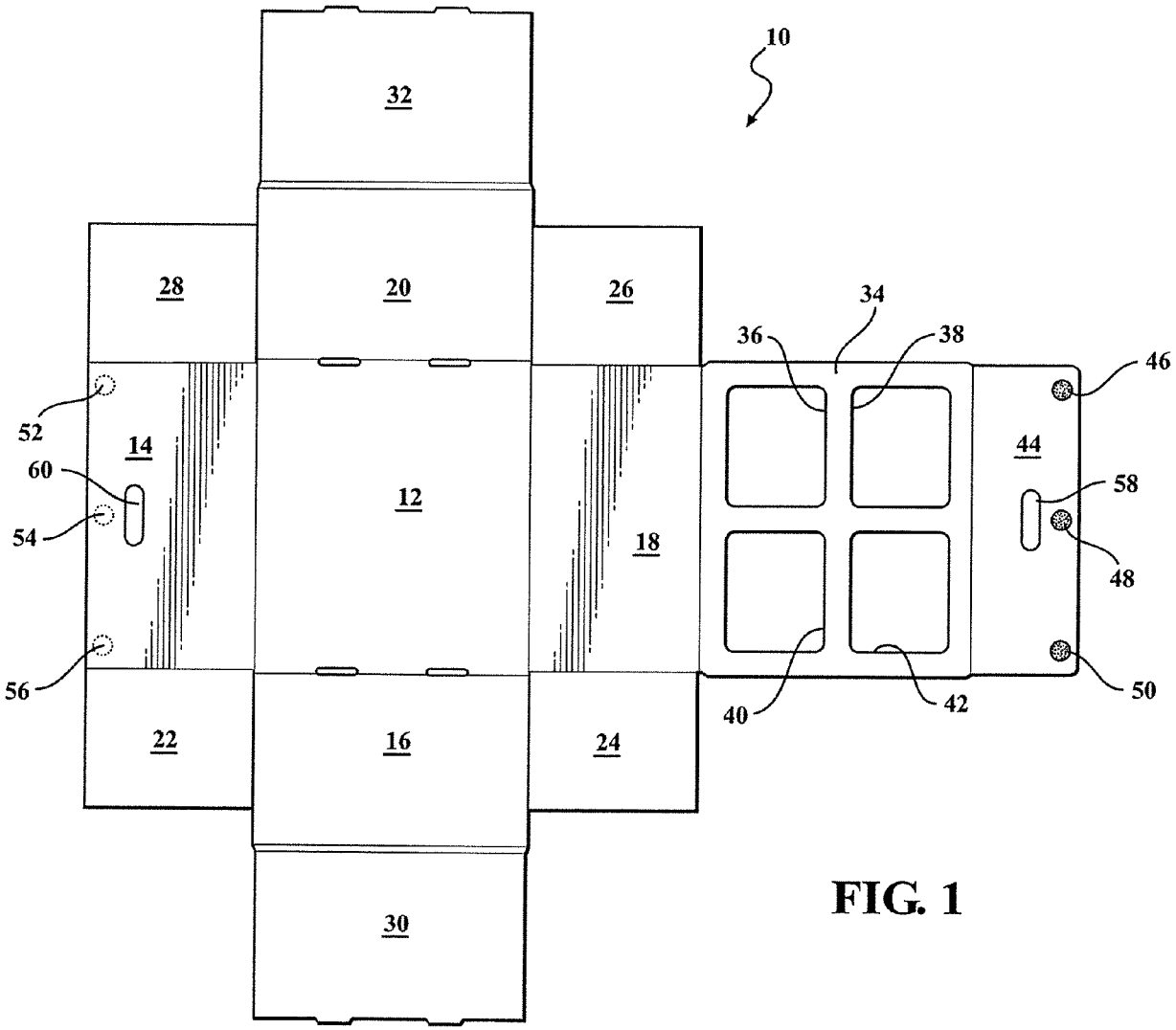
FIG. 1 is a plan view illustration of a blank construction for the foot locker according to one non-limiting embodiment of the present invention.

FIG. 1 is a plan view illustration, generally at 10, of a blank construction for the foot locker according to one non-limiting embodiment of the present invention. The locker exhibits a corrugated paperboard board and, as shown, the blank construction exhibiting a plurality of hingedly connected sides which are folded and interconnected along aligning edges in order to configure into a generally three dimensional rectangular body with an open interior.

As further shown in FIG. 1, the blank includes a rectangular shaped bottom panel 12, about which are arranged hinged side panels 14, 16, 18 and 20. Additional end flaps 22, 24, 26 and 28 are arranged in alternating fashion with the side panels 14-20, the end flaps arranged in pairs 22/28 and 24/26 which are hingedly connected to opposite side edges of the selected side panels 14 and 18 and, upon upwardly folding the side panels relative to the bottom into the open rectangular configuration, the ends flaps are folded over the exterior of the additional side panels 16 and 20.

The blank construction of FIG. 1 further includes additional fold over flaps 30/32 which are hingedly supported in extending fashion from outer edges of the side panels 16 and 20, the flaps 30/32 folding against inside surfaces of the panels 16 and 20 following placement of the end flaps 22/24 and 26/28 and in order to increase the structural integrity of the body.

A lid is depicted by a panel 34 which is hingedly connected to an outer edge of the side panel 18. The lid panel 34 includes one or more window apertures (depicted by a pair of four apertures 36, 38, 40 and 42), which are covered by a flexible mylar or other plastic material (as further shown at 37, 39, 41 and 43 in each of FIGS. 2-4) and such as which can be glued or otherwise adhered to either of outer or underside perimeter encircling edges of the lid panel.

A fold over flap 44 is hingedly associated with an outer edge the lid panel 34 and includes at least one hook and loop fastener portion (see portions 46, 48 and 50) configured on an inner facing surface and which, upon closing the lid panel 34 over the open top of the body, the fold over flap 44 inter-engages with additional and aligning hook and loop fastener portions (shown in phantom at 52, 54 and 56) which are configured upon the exterior facing surface of the side panel 14 shown in flattened blank form in FIG. 1. Hand hold apertures (see inner perimeter configured edges 58 and 60) are configured in each of the fold over flap 44 and aligning side flap 14 of the body and align upon closing and sealing the lid.

The hand hold aperture 58 can further exhibit fold-over creases which can engage the inner edges of the flap 60 in order to provide further structural integrity to the assembly. Construction of the body into the three dimensional rectangular configuration of FIGS. 2-4 can include the provision of any type of mechanical or chemical adhesives, such further being selected to ensure that the sides and flaps cannot be forcibly separated without substantially destroying the body.

Figure 2:
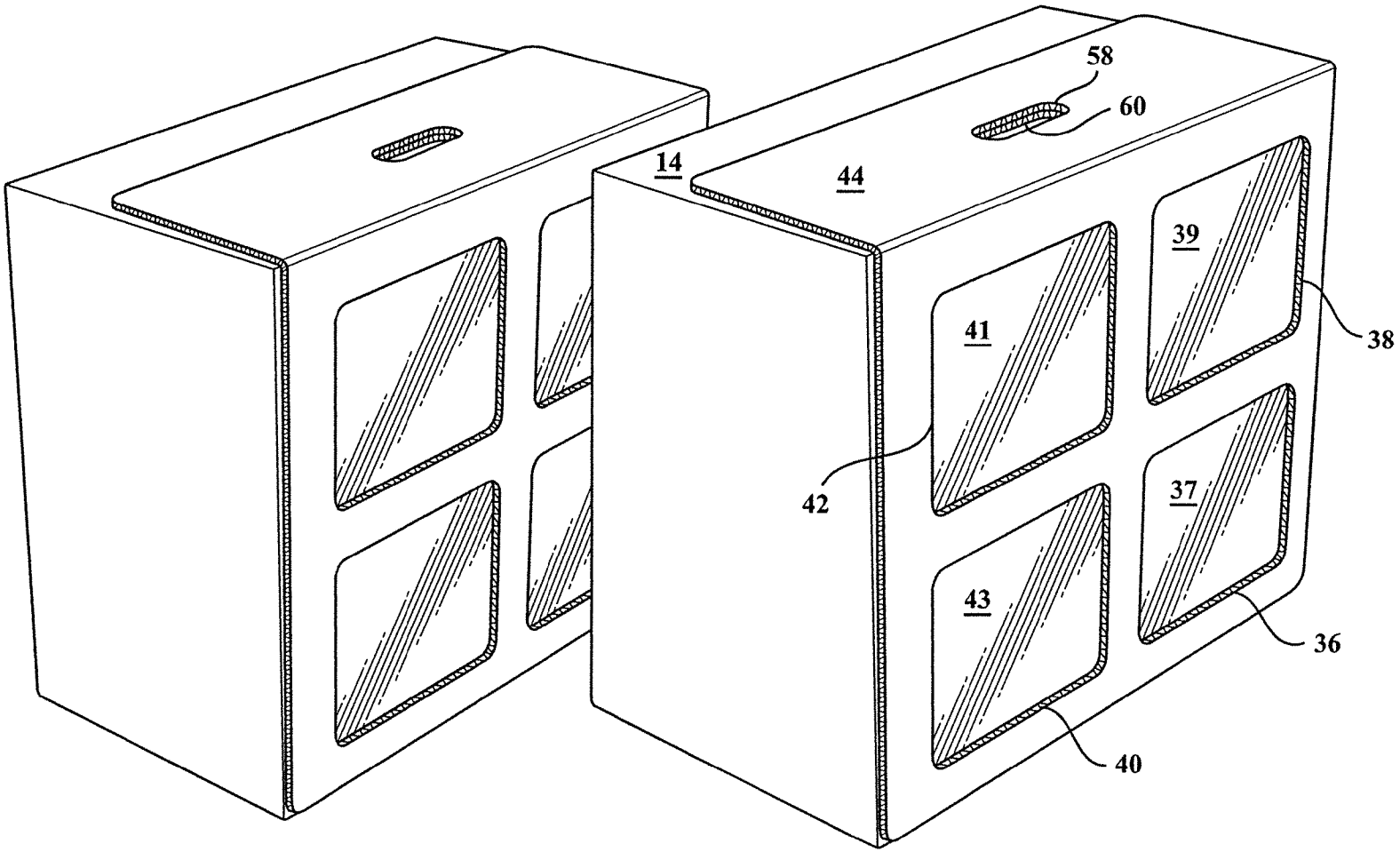
FIG. 2 illustrates a pair of foot lockers constructed according to the present invention.
Figure 3:
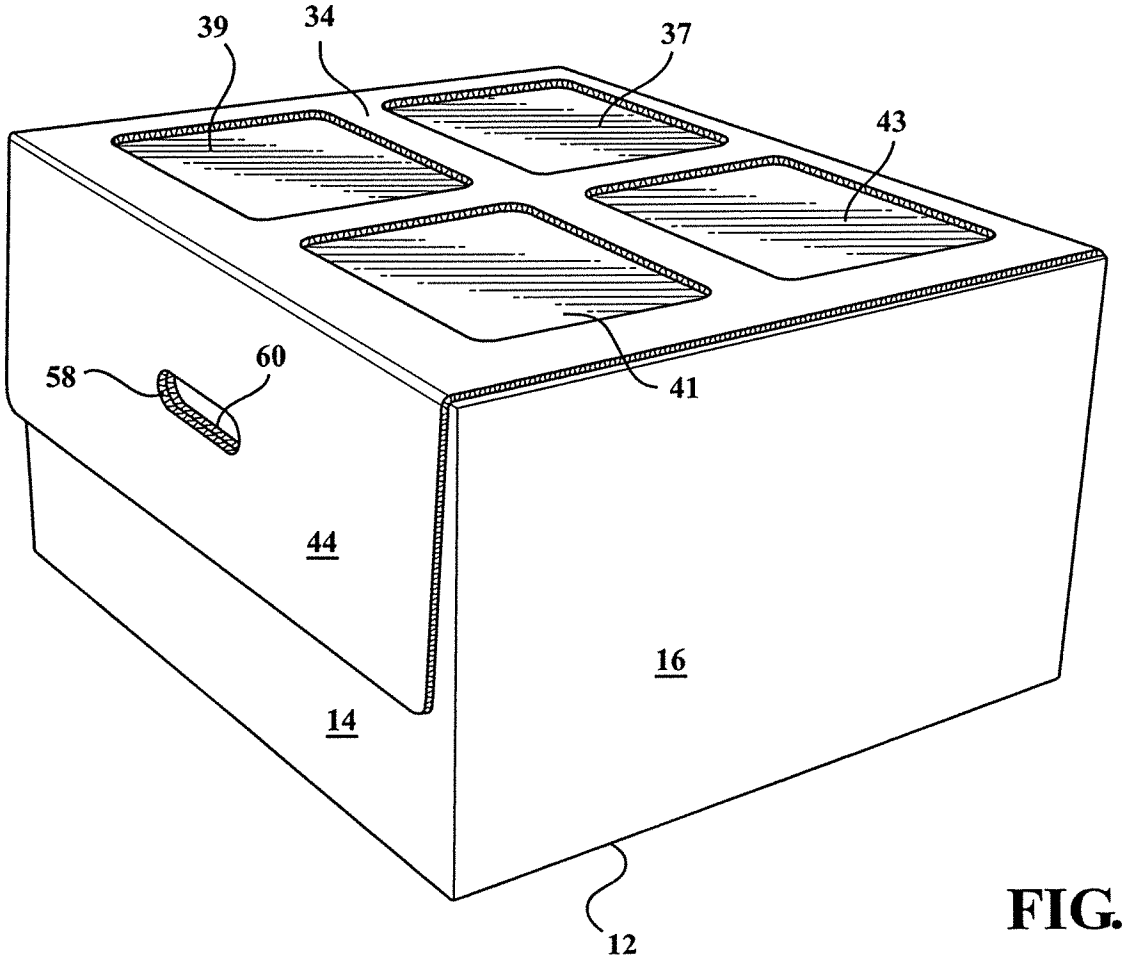
FIG. 3 is a rotated three dimensional perspective view of the foot locker from another angle.
Figure 4:
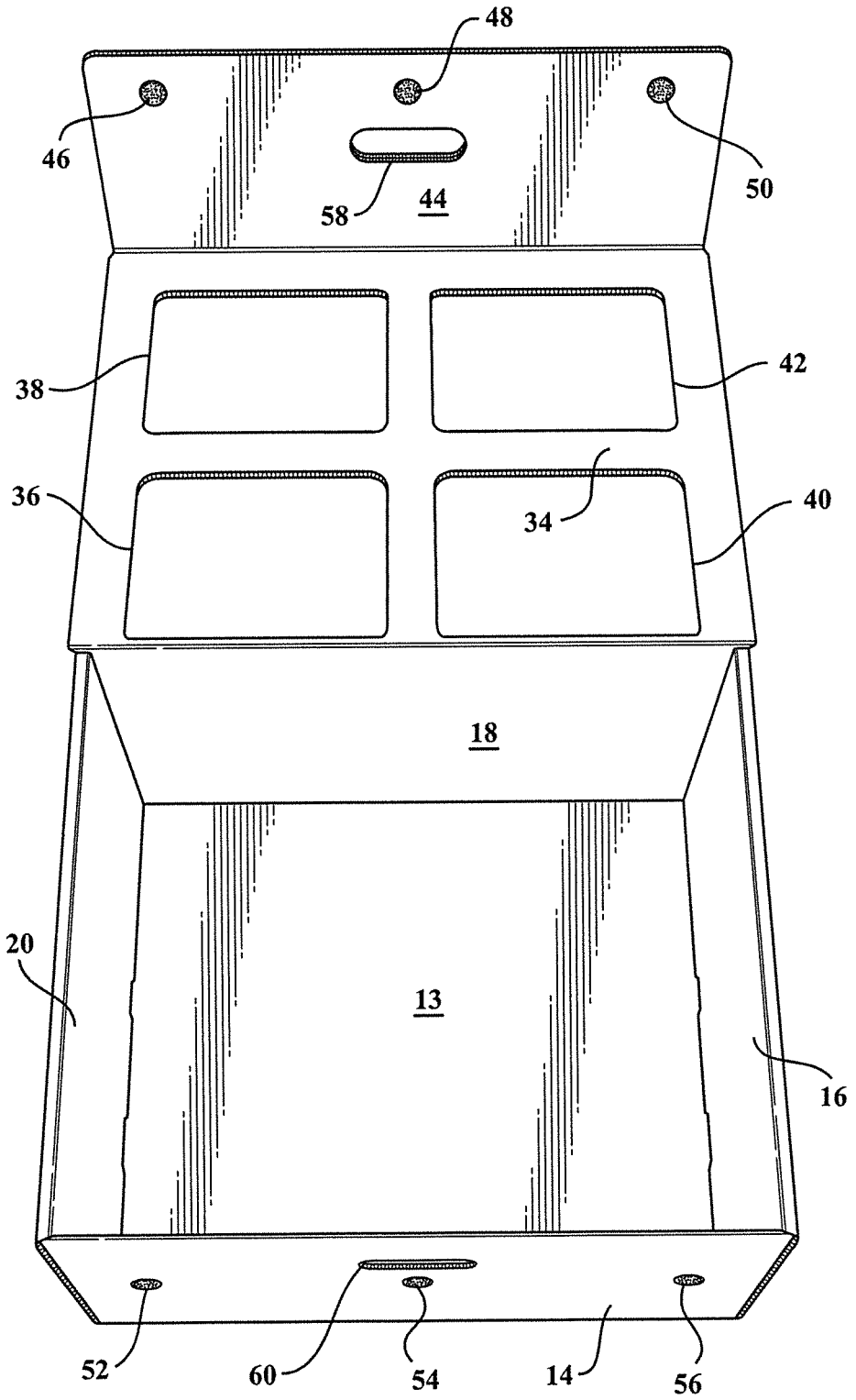
FIG. 4 is an open view of the foot locker of FIGS. 2-3 and best illustrating the opposing pluralities of hook and loop fasteners.

As further depicted in the following assembly views of FIGS. 2-4, the foot locker 10 can exhibit any shape or size not limited to the selected dimensions (in inches) depicted in the blank view of FIG. 1. It is also envisioned that the pluralities of hook and loop fasteners (commercial term Velcro®) can be substituted by other inter-engaging structure between the fold over flap 44 and aligning side edge 14, such including in non-limiting fashion the provision of in-molded twist and lock resealing portions). Without limitation, the resealing structure can also include other inter-engaging components, not limited to snaps, buttons or other resistive inter-engaging structure.

As previously described, the material construction of the foot locker includes a corrugated paperboard material which provides the necessary degree of sturdiness, while not being sufficiently rigid such that an inmate can incise and refashion a portion of the body with a sharp or pointed edge for use as a weapon. That said, and aside from the paperboard construction shown, it is envisioned that other materials can be substituted which provide similar properties of requisite structural integrity without the concern of an inmate refashioning any portion of the body as a weapon.

Having described my invention, other and additional preferred embodiments will become apparent to those skilled in the art to which it pertains, and without deviating from the scope of the appended claims.

I claim:

1. An inmate locker constructed of a rigid and non-weaponizable material, comprising:

a corrugated paperboard board having a generally three dimensional rectangular body with an open interior;

said body having a flattened blank construction including a rectangular shaped bottom panel about which are arranged hinged side panels, a lid hingedly attached along an edge thereof of said body, said lid including one or more window apertures which are covered by a flexible mylar or other plastic material adhered to outer or underside perimeter encircling edges of said lid;

said side panels being divided into a first selected panel extending from said bottom panel and hingedly attaching said lid, a pair of said side panels extending in opposite directions from said bottom panel, and a further selected panel extending from said bottom panel in a direction opposite said first selected panel;

end flaps arranged in alternating fashion with said side panels, said end flaps being arranged in pairs which are hingedly connected to opposite side edges of selected side panels and, upon upwardly folding said side panels relative said bottom into the open rectangular configuration, said ends flaps being folded over exterior surfaces of additional selected side panels;

said lid including a fold over flap exhibiting at least one inter-engaging portion configured on an inner facing surface and which, upon closing said lid over an open top of said body, interengages with an aligning inter-engaging portion configured upon an exterior facing side location of of said further selected panel; and hand hold apertures configured at overlapping locations in said fold over flap and said further selected side panel so that, upon closing and sealing said lid over said open top, reach in access is provided through alignment of the apertures.

2. The locker as described in claim 1, said inter-engaging portions further comprising hook and loop fastener portions.

3. The locker as described in claim 1, a selected one of said hand-hold apertures further comprising fold-over creases.

* * * * *